US008686911B2

(12) United States Patent
Kim

(10) Patent No.: US 8,686,911 B2
(45) Date of Patent: Apr. 1, 2014

(54) BEAM CONTROLLER FOR APERTURE ANTENNA, AND APERTURE ANTENNA THEREWITH

(75) Inventor: Young Wan Kim, Yongin (KR)

(73) Assignee: Lig Nexi Co., Ltd., Seoul (KR)

( * ) Notice: Subject to any disclaimer, the term of this patent is extended or adjusted under 35 U.S.C. 154(b) by 473 days.

(21) Appl. No.: 12/964,639

(22) Filed: Dec. 9, 2010

(65) Prior Publication Data

US 2011/0140980 A1 Jun. 16, 2011

(30) Foreign Application Priority Data

Dec. 10, 2009 (KR) ..... 10-2009-0122627

(51) Int. Cl.
*H01Q 13/00* (2006.01)

(52) U.S. Cl.
USPC ..... 343/786; 343/772; 343/781 R

(58) Field of Classification Search
USPC ..... 343/772, 786, 781 R
See application file for complete search history.

(56) References Cited

U.S. PATENT DOCUMENTS

| | | | | |
|---|---|---|---|---|
| 4,364,050 | A | 12/1982 | Lopez | |
| 5,258,768 | A * | 11/1993 | Smith | 343/786 |
| 5,977,924 | A | 11/1999 | Takei et al. | |
| 6,002,305 | A * | 12/1999 | Sanford et al. | 333/26 |
| 6,864,840 | B2 * | 3/2005 | Zhu et al. | 343/700 MS |
| 7,741,856 | B2 * | 6/2010 | Sugiura | 324/627 |

FOREIGN PATENT DOCUMENTS

KR 10-2005-0103608 A 11/2005

OTHER PUBLICATIONS

Office Action mailed on Apr. 2, 2013 for Chinese Patent Application No. 201010585263.5.

* cited by examiner

*Primary Examiner* — Tan Ho

(57) ABSTRACT

The present invention relates to an aperture antenna capable of controlling a shape of a radiated beam without changing a structure of an aperture antenna by connecting a beam controller with a single aperture antenna. the aperture antenna including a beam controller according to the present invention includes: a waveguide; an aperture horn of which one end is connected to the waveguide and the other end is provided with an opening; and a beam controller including a feeding unit connected to the opening and provided with a plurality of slits, a dielectric layer connected to the feeding unit, and a plurality of patches connected to the dielectric layer to control a beam shape of a signal introduced into the feeding unit and radiated through the patches.

14 Claims, 8 Drawing Sheets

BEAM CONTROLLER FOR APERTURE ANTENNA, AND APERTURE ANTENNA THEREWITH

BACKGROUND OF THE INVENTION

1. Field of the Invention

The present invention relates to a beam controller for an aperture antenna and an aperture antenna therewith, and more particularly, to a beam controller formed with a plurality of slits and a plurality of patches and an aperture antenna therewith to form an antenna beam in a desired form.

2. Description of the Related Art

Generally, an antenna radiates and receives radio waves into and from a free space. A standard for classifying the antenna is various. Typically, the antenna may be classified into a linear antenna, an aperture antenna, a microstrip antenna, an array antenna, a reflector antenna, a lens antenna, or the like.

The radio waves radiated from the antenna have a predetermined pattern, wherein the polarization of the radiated radio wave may be classified into a linearly polarized wave, a circularly polarized wave, an elliptically polarized wave, etc., according to a direction in which an electric field or a magnetic field is vibrated and a direction in which a wave is propagated.

Among the above-mentioned antennas, the array antenna implies an antenna that controls a phase of exciting current of each element by arranging a large number of antenna elements and controls a shape of a main beam by aligning the antennas in a specific direction and matching the phase of the antennas, and is mainly used for an automatic directional antenna for a satellite, etc.

There is a need to form the desired beam shape according to the field of use of the antenna. However, a single antenna, a horn antenna cannot form the antenna beam in the desired shape until the physical sizes of the antenna are changed.

SUMMARY OF THE INVENTION

The present invention has been made in an effort to provide a beam controller easily forming a desired beam at low cost without changing the physical size of an antenna by using a beam shaping mechanism for inserting a multi-layer substrate into a single antenna and an aperture horn antenna therewith.

An exemplary embodiment of the present invention provides a horn antenna, including: a waveguide; an aperture horn of which one end is connected to the waveguide and the other end is provided with an opening; and a beam controller including a feeding unit connected to the opening and provided with a plurality of slits, a dielectric layer connected to the feeding unit, and a plurality of patches connected to the dielectric layer to control a beam shape of a signal introduced into the feeding unit and radiated through the patches.

The beam controller may be a quadrangular multi-layer substrate when the aperture horn is a pyramid type horn.

The beam controller may be a disc type multi-layer substrate when the aperture horn is a circular horn.

The beam controller may control the beam shape of the signal according to any one of the length of the slit and the gradient of the slit with respect to the electric field direction of the radiated signal.

The beam controller may be connected with the inner surface of the opening.

The beam controller may be connected with the end of the opening.

The plurality of slits may be formed to increase the strength of the signal radiated through the corresponding patch as they proceed toward the central portion of the beam controller from the edge thereof.

The plurality of slits may be formed in the electric field direction of the radiated signals.

Each of the plurality of slits may be extendedly formed as they proceed toward the central portion of the beam controller from the edge thereof.

Each of the plurality of slits may be formed to increase an angle with respect to the electric field direction as they proceed toward the central portion of the beam controller from the edge thereof.

Another exemplary embodiment of the present invention provides a waveguide antenna, including: a waveguide of which the end is formed with an opening; and a beam controller including a feeding unit connected to the opening and provided with a plurality of slits, a dielectric layer connected to the feeding unit, and a plurality of patches connected to the dielectric layer to control a beam shape of a signal introduced into the feeding unit and radiated through the patches.

The beam controller may control the beam shape of the signal according to any one of the length of the slit and the gradient of the slit with respect to the electric field direction of the radiated signal.

The beam controller may be connected with the inner surface of the opening or the end of the opening.

The plurality of slits may be formed in the electric field direction of the radiated signal to increase the strength of the signal radiated through the corresponding patch as they proceed toward the central portion of the beam controller from the edge thereof.

The plurality of slits may be extendedly formed as they proceed toward the central portion of the beam controller from the edge thereof.

Each of the plurality of slits may be formed to have a predetermined angle with respect to the electric field direction.

Yet another exemplary embodiment of the present invention provides a beam controller, including: a feeding unit connected with an opening of an aperture antenna and formed with a plurality of slits; a dielectric layer connected with the feeding unit to prevent loss of the fed signals; and a plurality of patches connected with the dielectric layer to radiate the fed signals to the air, wherein it controls the beam shape of the signal according to any one of the length of the slit and the gradient of the slit with respect to the electric field direction of the radiated signal.

The plurality of slits may be formed to increase the strength of the signal radiated through the corresponding patch as they proceed toward the central portion of the beam controller from the edge thereof.

Each of the plurality of slits may be extendedly formed as they proceed toward the central portion of the beam controller from the edge thereof.

Each of the plurality of slits may be formed to increase an angle with respect to the electric field direction of the signal as they proceed toward the central portion of the feeding unit from the edge thereof.

According to exemplary embodiments of the present invention, the beam controller and the aperture antenna therewith can easily form the radiated beam in the desired shape without changing the physical structure of the antenna.

Further, according to exemplary embodiments of the present invention, the beam controller and the aperture antenna therewith can control the beam shape using the beam controller formed in the multi-layer substrate, thereby making it possible to reduce the manufacturing costs of the aperture antenna.

DETAILED DESCRIPTION OF THE EMBODIMENTS

Figure 1:
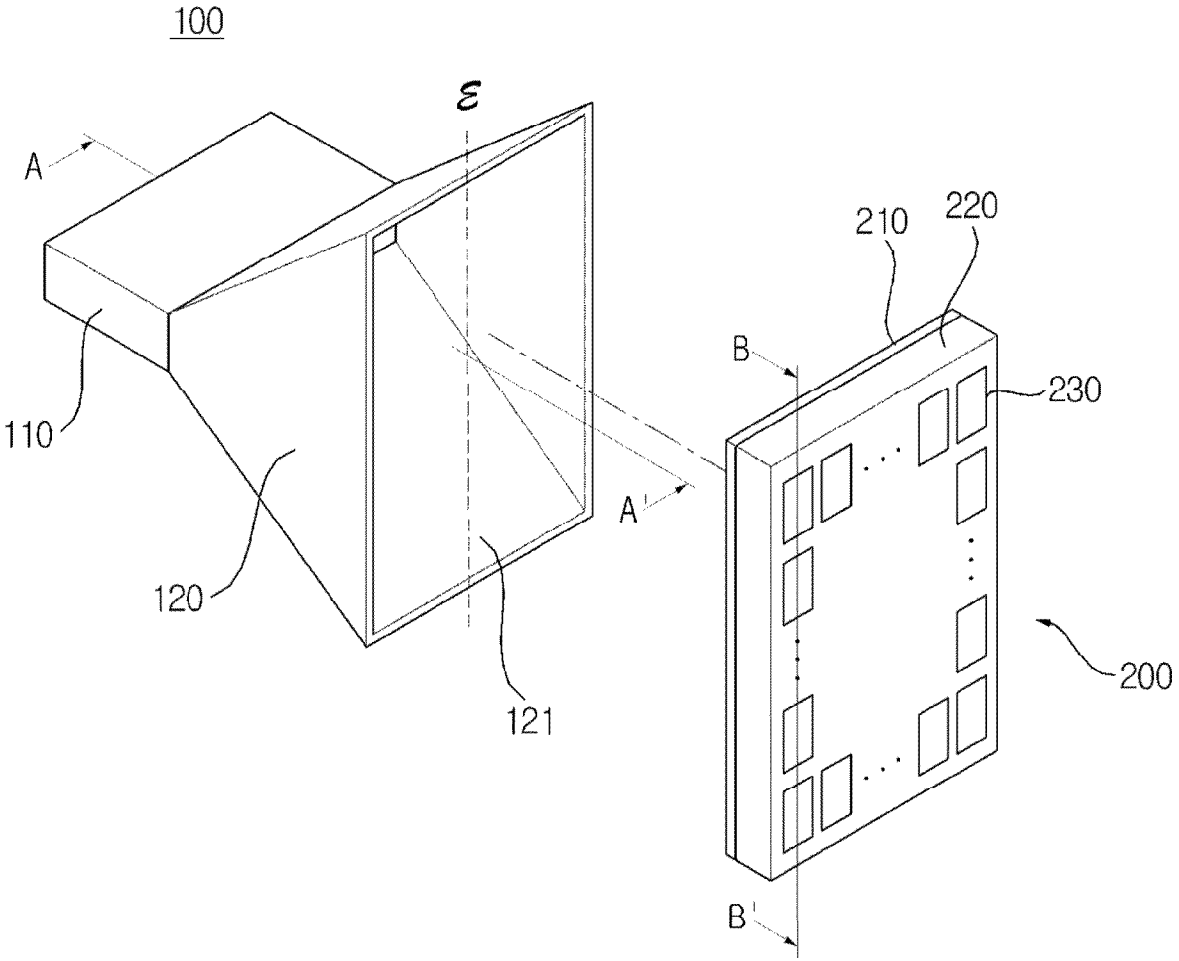
FIG. 1 is an exploded perspective view of an aperture horn antenna including a beam controller according to an exemplary embodiment of the present invention.

Hereinafter, exemplary embodiments of the present invention will be described in detail with reference to the accompanying drawings. First of all, it is to be noted that in giving reference numerals to elements of each drawing, the same reference numerals refer to the same elements even though the same elements are shown in different drawings. Further, in describing the present invention, the relevant well-known functions or constructions will not be described in detail in a case where it is judged that they may obscure the gist of the present invention, and the terminologies described in a singular include the plural concept. Hereinafter, the exemplary embodiment of the present invention will be described, but it will be understood to those skilled in the art that the spirit and scope of the present invention are not limited thereto and various modifications and changes can be made.

Figure 2:
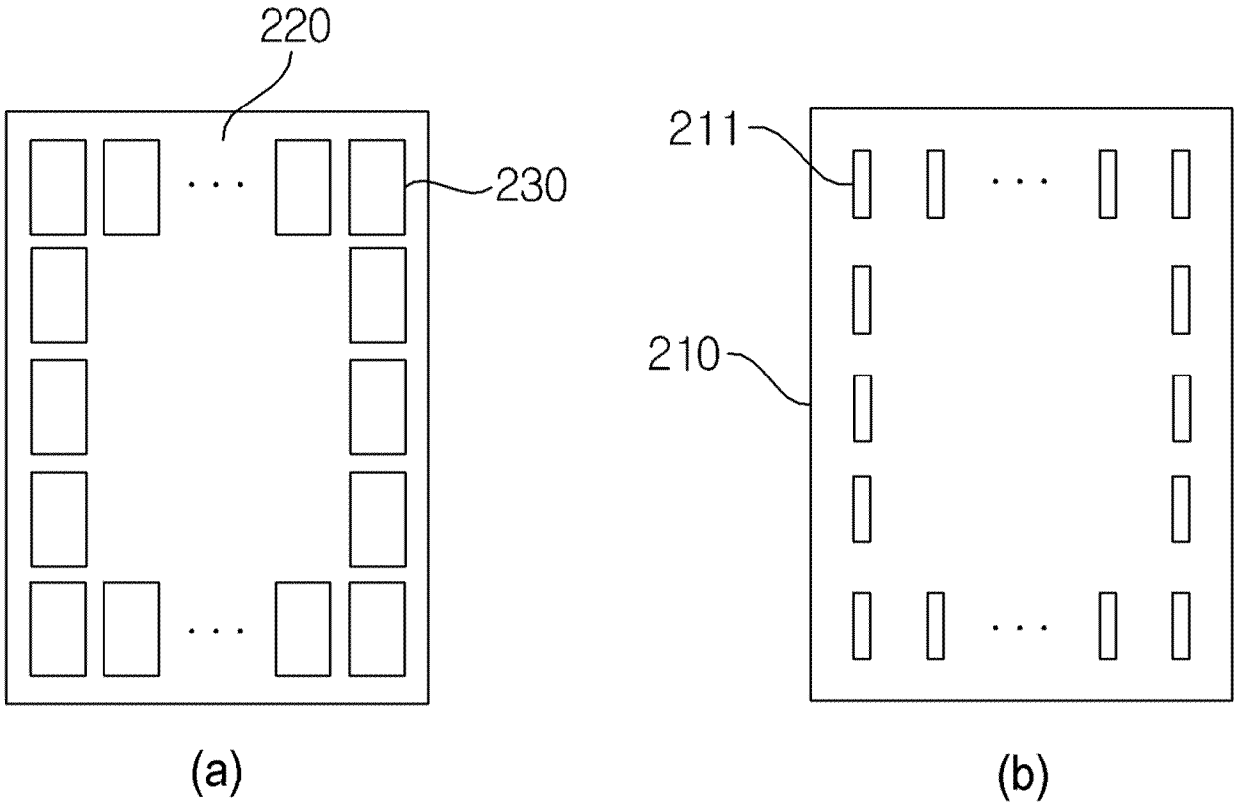
FIGS. 2A and 2B are a front view and a rear view of a beam controller according to the exemplary embodiment of the present invention, respectively.
Figure 3:
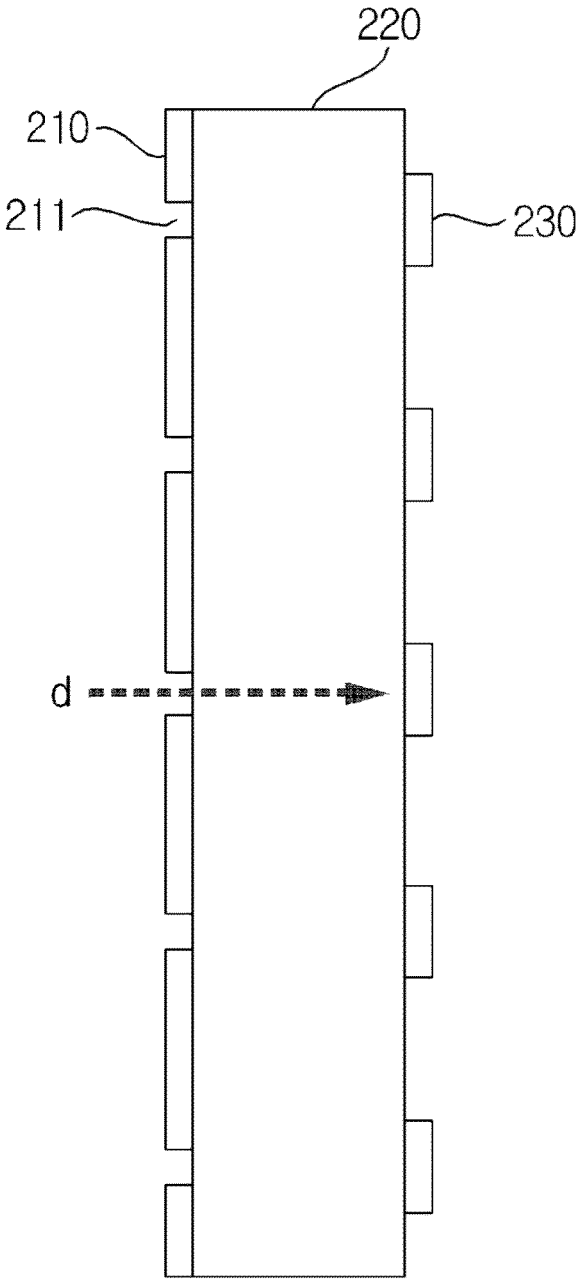
FIG. 3 is a side cross-sectional view of a beam controller taken along line B-B' of FIG. 1.
Figure 4:
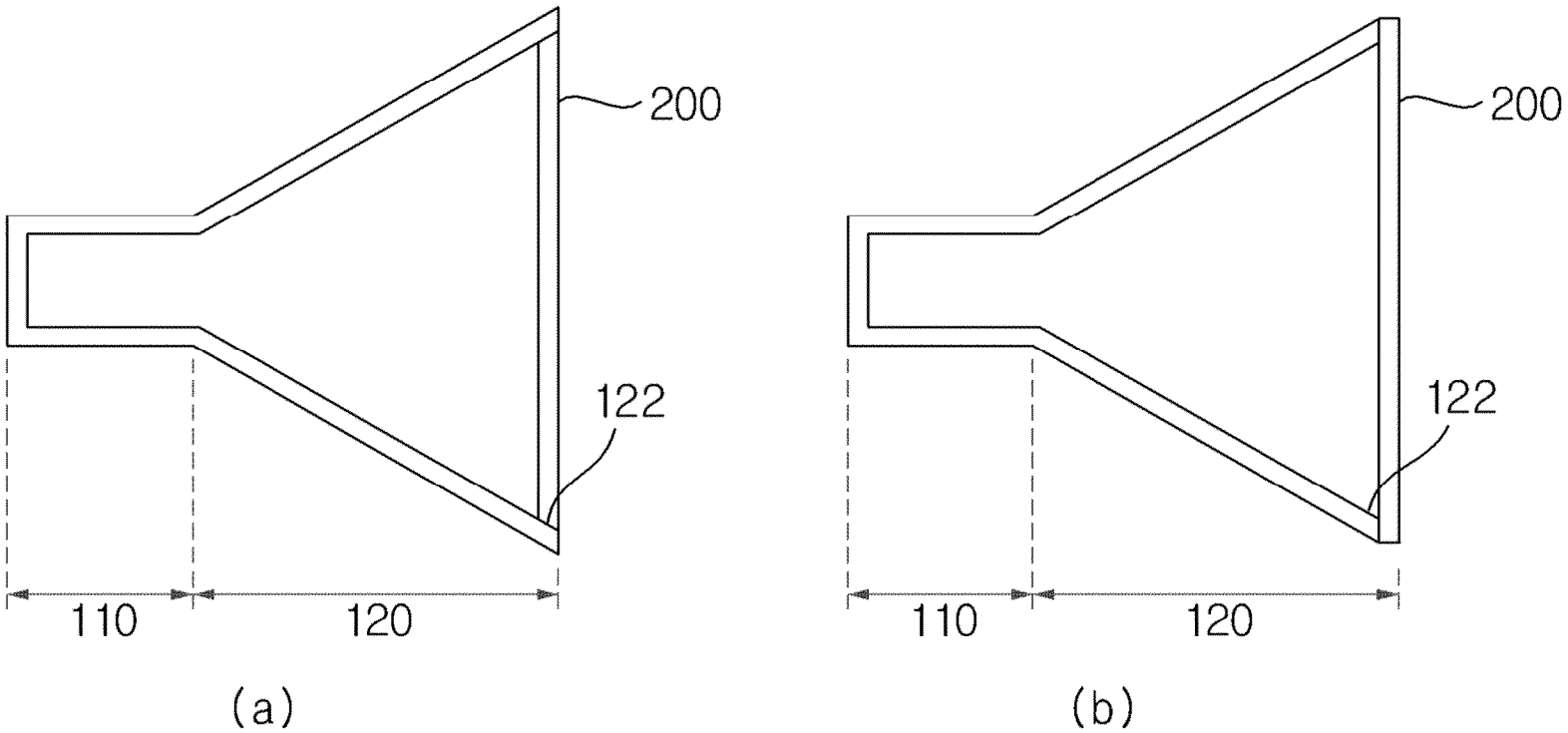
FIGS. 4A and 4B are two types of side cross-sectional views of an aperture horn antenna taken along line A-A' of FIG. 1, respectively.

FIG. 1 is an exploded perspective view of an aperture horn antenna including a beam controller according to an exemplary embodiment of the present invention, FIGS. 2A and 2B are a front view and a rear view of a beam controller according to the exemplary embodiment of the present invention, respectively, FIG. 3 is a side cross-sectional view of a beam controller taken along line B-B' of FIG. 1, and FIGS. 4A and 4B are two types of side cross-sectional view of an aperture horn antenna taken along line A-A' of FIG. 1, respectively.

Hereinafter, an aperture horn antenna 100 and a beam controller 200 according to an exemplary embodiment of the present invention will be described in detail with reference to FIGS. 1 to 4B.

Referring to FIGS. 1 to 3, the aperture horn antenna 100 according to an exemplary embodiment of the present invention is configured to include a waveguide 110; an aperture horn 120 of which one end is connected to the waveguide and the other end is provided with an opening 121; a feeding unit 210 coupled with the opening and provided with a plurality of slits 211; a beam controller 200 including a dielectric layer 220 connected to the feeding unit, and a plurality of patches 230 connected to the dielectric layer to control a beam shape of a signal introduced into the feeding unit and radiated through the patches.

The beam controller 200 is formed in a quadrangular multi-layer substrate when the shape of the aperture horn is a pyramid shape and is formed in a disc type multi-layer substrate when the shape of the aperture horn is a circular shape.

The plurality of slits 211 may be formed to have various lengths L and various angles θ with respect to an electric field direction of a radiated signal on a plate of a metal material, i.e., the feeding unit 210. In addition, the plurality of slits 211 may be formed to have the same length and the same angle on the feeding unit and may be formed to have different angles and different lengths according to the desired beam shape.

The beam controller 200 can control the beam shape of the signal according to at least one of the length L of the slit and the gradient θ of the slit with respect to the electric field direction ∈ of the radiated signal.

Referring to FIGS. 2A to 3, the signal spatially fed into the aperture horn 120 from the waveguide 110 is individually fed into the beam controller 200 through the plurality of slits 211 formed at rear surface of the beam controller 200, and is radiated from the plurality of patches 230 formed at the front surface of the beam controller 200, and is shaped in the desired beam shape. The aperture horn antenna 100 is able to have a variety of the size/number of the slits and a variety of the size of the patches formed at the beam controller to control the size/phase of the signal radiated from each of the patches, thereby making it possible to obtain the same effect as an array antenna. That is, even when the single horn antenna is used, the aperture horn antenna can control the beam shape, similarly to the array antenna.

The beam controller 200 is formed as follow.

An metal layer is formed on the front and rear surfaces of the dielectric layer 220, and then is removed the remaining metal layer other than the patch portion in order to form the plurality of patches 230 on the front surface of the dielectric layer 220 and is removed the metal layer portion corresponding to the plurality of slits 211 in the metal layer of the rear surface of the dielectric layer 220. In this case, as a method of removing the metal layer, an etching method is generally used. That is, the polarity of slits use the principle where the signal is incident to the metal and then reflected therefrom, but is introduced into the metal gap. The signal individually fed to the slit is radiated through the plurality of patches at a loss rate as low as possible without removing an intermediate layer, i.e., the dielectric layer between the feeding unit 210 formed with the plurality of slits and the plurality of patches.

Referring to FIGS. 4A and 4B, the beam controller 200 is connected to the opening 121 of the aperture horn. In this case, as shown in FIG. 4A, the beam controller 200 may be connected with the opening 121 of the aperture horn by being inserted thereinto so that the distal inner surface 122 of the opening of the aperture horn contacts the edge side surface of the beam controller. Further, as shown in FIG. 4B, the beam controller 200 may be connected with the opening 121 of the aperture horn so that a cross section of the opening 121 of the horn contacts the edge of the feeding unit. The former connection form facilitates the connection. Even in this case, it is preferable to connect the beam controller with the opening by using a dielectric screw inserted into the beam controller from the outer distal end of the opening.

As the plurality of slits 211 proceed toward the central portion of the beam controller from the edge thereof, it can be formed so that the strength of the signal radiated from the corresponding patches is increased. In this case, it is preferable that each of the plurality of slits 211 is extendedly formed as they proceed toward the central portion of the beam controller 200 from the edge thereof or each of the plurality of slits is formed so that an angle with respect to the electric field direction is increased as they proceed toward the central portion of the beam controller from the edge thereof.

Due to the form and arrangement of the slit, when the beam strength becomes large at the central portion of the beam controller and the beam strength is weak at the remaining portion of the edge thereof, that is, when sidelobes are small and the beam is collected to the center thereof, the beam width is narrow, which may be applied to applications requiring the narrow beam width. Further, the form and arrangement of the slit are appropriately controlled according to the change in the length of the slit and the change in the angle of the slit, thereby making it possible to obtain the beam form different from the above-mentioned beam shape.

Figure 5:
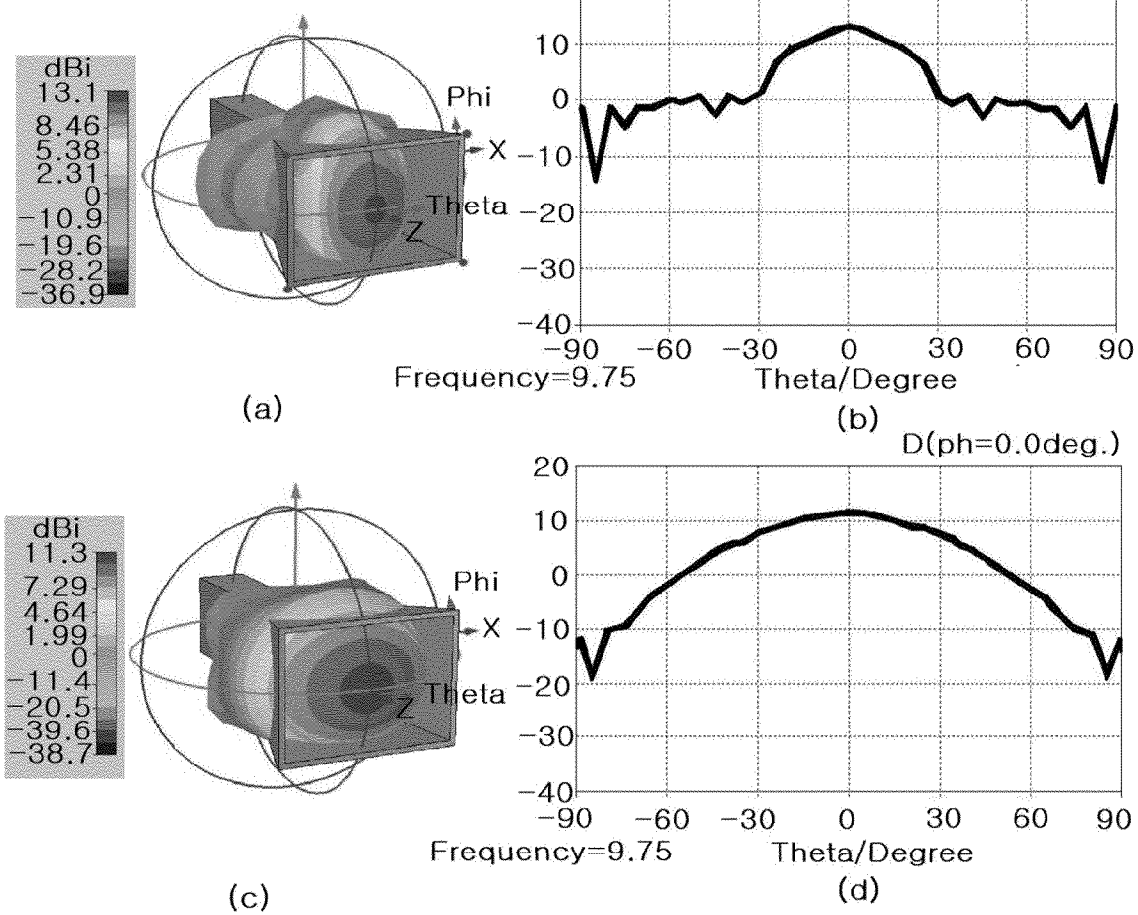
FIGS. 5A and 5B and FIGS. 5C and 5D are comparative views of the beam shape of the aperture horn antenna of the related art and the beam shape of the aperture horn antenna according to the exemplary embodiment of the present invention.

FIGS. 5A and 5B show the aperture horn antenna of the related art and the beam shape of the horn antenna of the related art, and FIGS. 5C and 5D show the aperture horn antenna including the beam controller and the beam shape of the aperture horn antenna according to the exemplary embodiment of the present invention. FIG. 5C shows a state where the beam controller is removed from the aperture horn antenna of FIG. 1, for visual convenience.

Referring to FIGS. 5A to 5D, the aperture horn antenna of the related art is formed so that the shape of the beam radiated from the opening is small at the center thereof, while the aperture horn antenna according to the exemplary embodiment of the present invention may change the azimuth/elevation, direction, and number of the slits and the size of the slits, such that it can control beams to obtain the desired beam shape, similar or equal to the array antenna where the plurality of antennas are arranged. Therefore, the signal fed through the slits forms the desired beam shape by concentrating the energy of the signal toward the central portion of the opening through the patches.

Figure 6:
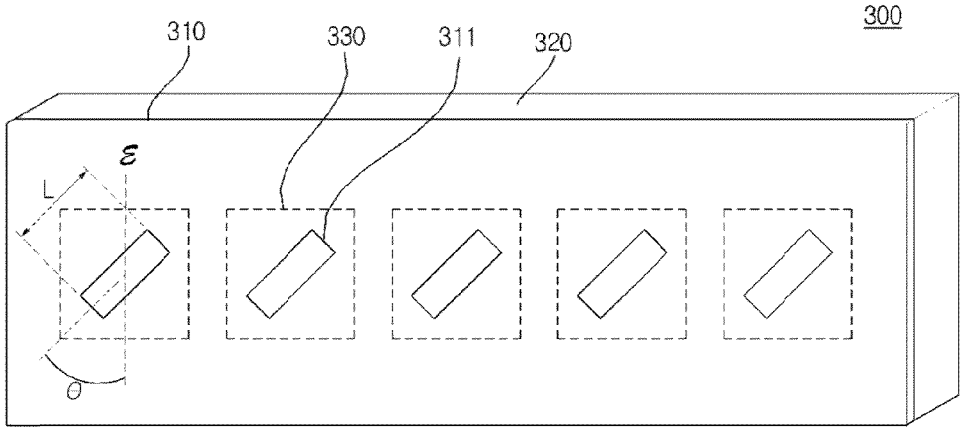
FIG. 6 is a rear view of the beam controller formed with the slits according to the exemplary embodiment of the present invention.
Figure 7:
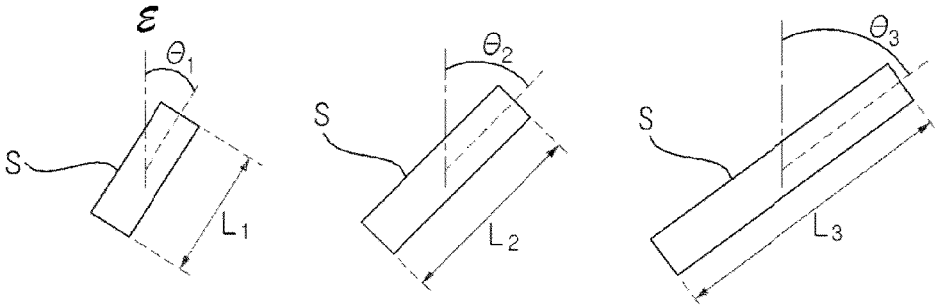
FIG. 7 shows the slits having various lengths and gradients formed in the beam controller.
Figure 8:
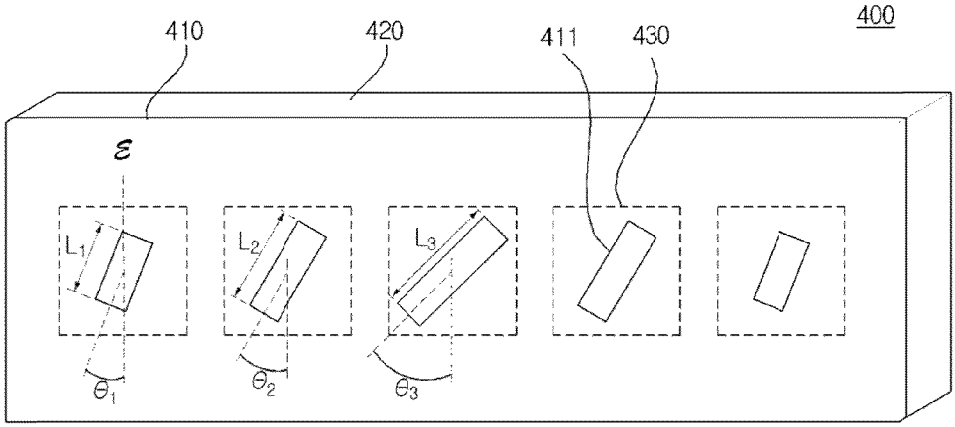
FIG. 8 is a rear view of the beam controller formed with the slits according to another exemplary embodiment of the present invention.

FIG. 6 is a rear view of the beam controller formed with the slits according to the exemplary embodiment of the present invention, FIG. 7 shows the slits having various lengths and gradients formed in the beam controller, and FIG. 8 is a rear view of the beam controller formed with the slits according to another exemplary embodiment of the present invention.

As described above, the beam controller according to the exemplary embodiments of the present invention controls the gradients of the plurality of slits and the lengths of the slits formed on the rear surface to determine the signal strength emitted from the slits.

Referring to FIG. 6, a beam controller 300 according to another exemplary embodiment of the present invention includes five slits 311 formed on the rear surface thereof in a direction vertical to the electric field direction $\in$ from a feeding unit 310 based on a dielectric layer 320 and five patches 330 formed on the front surface thereof. The five patches 330 have the same size and the five slits are the same in terms of the length L and the angle $\theta$ with respect to the electric field direction $\in$, such that the size of the signal radiated through each slit becomes the same.

The beam controller controls the length of each of the plurality of slits and the gradient $\theta$ with respect to the electric field direction to make the size of the signals fed through the plurality of slits formed on the rear surface relatively different.

Referring to FIGS. 7 and 8, the user designs the beam controller 400 including the five patches 430 and the corresponding five slits 411 so that the size of the signals radiated from the center of the opening of the aperture horn is larger than that radiated from the edge of the opening of the aperture horn, such that the ratio of the magnitude in signals radiated through the patches 430 may be 1:2:3:2:1.

First, as shown in FIG. 7, the lengths L1, L2, and L3 and gradients $\theta$1, $\theta$2, and $\theta$3 of the slit S formed from the edge to the center are obtained so that the ratio of the magnitude in signals becomes 1:2:3. The slits 411 are formed in the beam controller 400 to be symmetrical left and right from the center of the patch 430 by using the obtained lengths and gradients of the slits. The beam controller 400 radiates the signals having small energy to the edge thereof and radiates the signals having large energy to the central portion thereof, such that the radiated beam shape becomes a user's desired shape.

Here, the length of the slit S is $L1<L2<L3$ and the gradient of the slit S $\theta1<\theta2<\theta3$.

Figure 9:
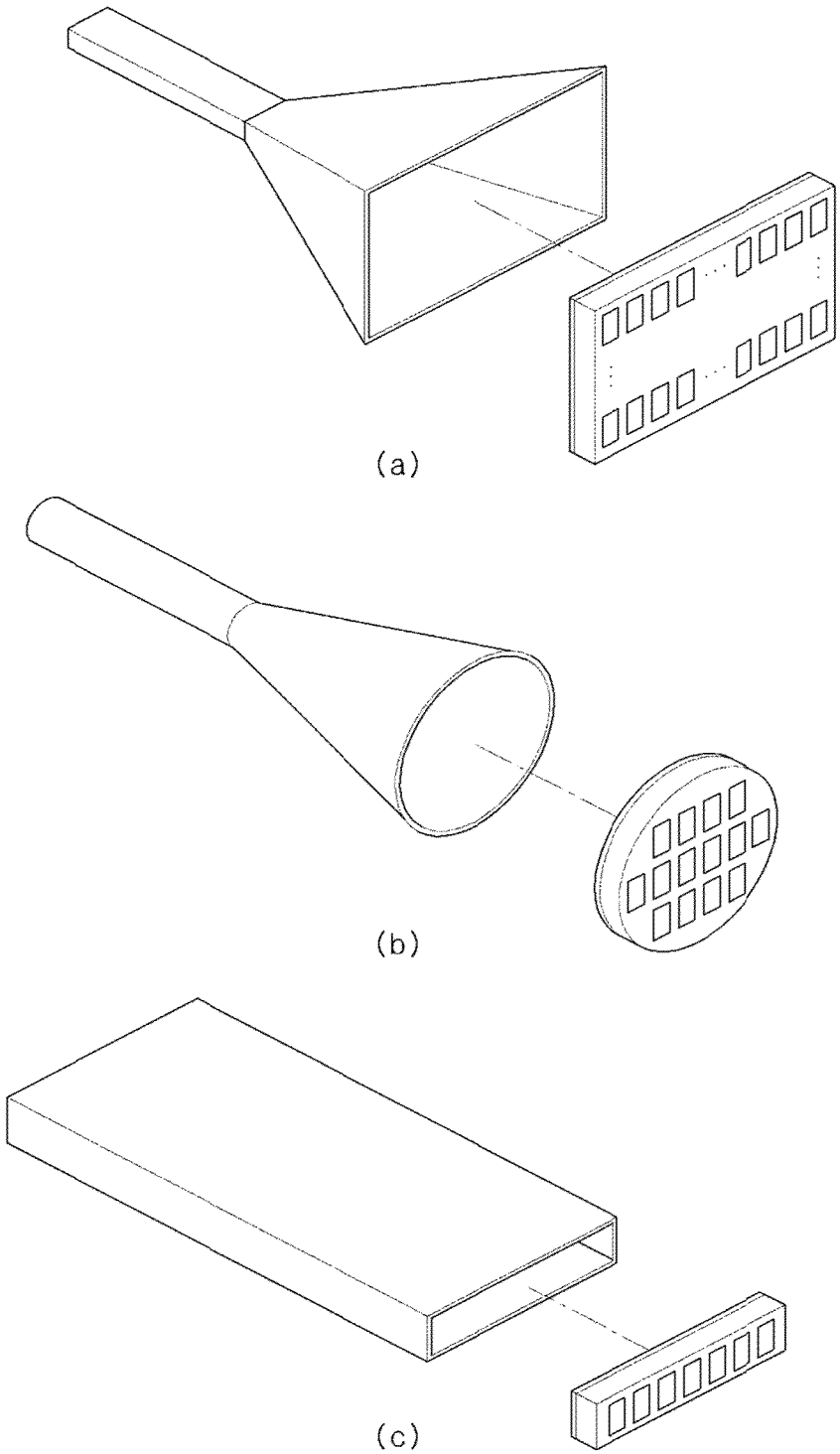
FIGS. 9A to 9C show examples of the aperture horn antenna and the waveguide antenna connectable to the beam controller according to the exemplary embodiments of the present invention.

FIGS. 9A to 9C show examples of the aperture horn antenna and the waveguide antenna connectable to the beam controller according to the exemplary embodiments of the present invention.

FIG. 9A shows an example where the pyramid type horn antenna of the related art is connected with the rectangular plate beam controller, FIG. 9B shows an example where the circular horn antenna of the related art is connected with the disc beam controller, and FIG. 9C shows an example where the waveguide antenna of the related art is connected with the rectangular plate beam controller.

The beam controller may be removable from the opening of the aperture horn antenna or the waveguide antenna. In this case, it is preferable that the removable member of the beam controller is provided in the opening. Further, the removable member of the beam controller can be formed in the beam controller.

As described above, the aperture horn antenna including the beam controller in the multi-layer substrate form formed with the plurality of slits and the plurality of patches according to the exemplary embodiments of the present invention can form the beam shape of the signal radiated from the single antenna.

The spirit of the present invention has been just exemplified. It will be appreciated by those skilled in the art that various modifications, changes, and substitutions can be made without departing from the essential characteristics of the present invention. Accordingly, the embodiments disclosed in the present invention and the accompanying drawings are used not to limit but to describe the spirit of the present invention. The scope of the present invention is not limited only to the embodiments and the accompanying drawings. The protection scope of the present invention must be analyzed by the appended claims and it should be analyzed that all spirits within a scope equivalent thereto are included in the appended claims of the present invention.

What is claimed is:

1. A horn antenna, comprising:

a waveguide;

an aperture horn of which one end is connected to the waveguide and the other end is provided with an opening, the aperture horn configured to receive a signal spatially fed from the waveguide; and a beam controller including a feeding unit connected to the opening and provided with a plurality of slits, a dielectric layer connected to the feeding unit, and a plurality of patches connected to the dielectric layer to control a beam shape of the signal introduced into the feeding unit from the aperture horn and radiated through the patches, wherein the plurality of slits are formed to increase the strength of the signal radiated through the corresponding patch as they proceed toward the central portion of the beam controller from the edge thereof.

2. The horn antenna according to claim 1, wherein the beam controller is a quadrangular multi-layer substrate when the aperture horn is a pyramid type horn.

3. The horn antenna according to claim 1, wherein the beam controller is a disc type multi-layer substrate when the aperture horn is a circular horn.

4. The horn antenna according to claim 1, wherein the beam controller controls the beam shape of the signal according to any one of the length of the slit and the gradient of the slit with respect to the electric field direction of the radiated signal.

5. The horn antenna according to claim 1, wherein the beam controller is connected with the inner surface of the opening.

6. The horn antenna according to claim 1, wherein the beam controller is connected with the end of the opening.

7. The horn antenna according to claim 1, wherein the plurality of slits are formed in the electric field direction of the radiated signals.

8. The horn antenna according to claim 7, wherein each of the plurality of slits is extendedly formed as they proceed toward the central portion of the beam controller from the edge thereof.

9. The horn antenna according to claim 7, wherein each of the plurality of slits is formed to increase an angle with respect to the electric field direction as they proceed toward the central portion of the beam controller from the edge thereof.

10. A waveguide antenna, comprising:

a waveguide of which the end is formed with an opening; and a beam controller including a feeding unit connected to the opening and provided with a plurality of slits, a dielectric layer connected to the feeding unit, and a plurality of patches connected to the dielectric layer to control a beam shape of a signal spatially fed into the feeding unit from the waveguide and radiated through the patches, wherein the plurality of slits are formed in the electric field direction of the radiated signal to increase the strength of the signal radiated through the corresponding patch as they proceed toward the central portion of the beam controller from the edge thereof.

11. The waveguide antenna according to claim 10, wherein the beam controller controls the beam shape of the signal according to any one of the length of the slit and the gradient of the slit with respect to the electric field direction of the radiated signal.

12. The waveguide antenna according to claim 10, wherein the beam controller is connected with the inner surface of the opening or the end of the opening.

13. The waveguide antenna according to claim 10, wherein the plurality of slits are extendedly formed as they proceed toward the central portion of the beam controller from the edge thereof.

14. The waveguide antenna according to claim 10, wherein each of the plurality of slits is formed to have a predetermined angle with respect to the electric field direction.

* * * * *